United States Patent [19]

Kowal

[11] 4,380,922

[45] Apr. 26, 1983

[54] TUBE BENDER CONSTRUCTION

[75] Inventor: Leonard J. Kowal, Prospect Heights, Ill.

[73] Assignee: Imperial Clevite Inc., Rolling Meadows, Ill.

[21] Appl. No.: 229,865

[22] Filed: Jan. 30, 1981

[51] Int. Cl.[3] ..... B21D 7/02

[52] U.S. Cl. ..... 72/388; 72/459

[58] Field of Search ..... 72/459, 458, 457, 388, 72/387, 217, 461, 32, 33, 34, 35, 36, 702

[56] References Cited

U.S. PATENT DOCUMENTS

| | | | |
|---|---|---|---|
| 2,796,785 | 6/1957 | Philippe | 72/388 |
| 2,887,917 | 5/1959 | Kowal | 72/388 |
| 3,126,773 | 3/1964 | Taylor | 72/33 |
| 3,448,602 | 6/1969 | Stanley | 72/217 |
| 3,729,975 | 5/1973 | Del Monica | 72/32 |
| 3,750,447 | 8/1973 | Kowal | 72/459 |
| 3,926,028 | 12/1975 | Kowal | 72/388 |

*Primary Examiner*—Gene Crosby

*Attorney, Agent, or Firm*—Wood, Dalton, Phillips, Mason & Rowe

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal movement during the bending operation by tube holding structure arranged to clamp the tube against an extended groove portion of the mandrel. Movement of the forming member about the bending axis is effected by manipulation of a pair of handles. Indicia are provided on the mandrel and forming member for indicating the angular extent of a bend provided in the tube as a result of the swinging movement of the forming member about the bending axis. At least one of the first and second indicia are adjustably mounted to provide accurate correlation between the indicia in indicating the bend angular extent.

19 Claims, 8 Drawing Figures

TUBE BENDER CONSTRUCTION

BACKGROUND OF THE INVENTION

1. Field of the Invention

This invention relates to tube benders and in particular to manually operable tube benders wherein a forming member is swung about a mandrel bending axis by means of a handle associated therewith and a handle mounted to the mandrel.

2. Description of the Background Art

Manually operable tube benders are well known in the art. One improved form of such tube bender is illustrated in U.S. Pat. No. 2,796,785 of Howard L. Philippe. As shown therein, a shoe forming member is provided with a handle. The shoe is swingably mounted to a mandrel for pivotal movement about a bending axis. A second handle is connected to the mandrel. A hook is swingably mounted on the second handle for engaging the tube at a point adjacent the bend start point of a groove in the periphery of the mandrel into which the tube is urged in the bending operation. A scale is provided on the mandrel and a cooperating indicating mark is provided on the shoe.

Further improved tube benders are illustrated in U.S. Pat. Nos. 2,887,917 and 3,926,028 of the inventor herein. In U.S. Pat. No. 2,887,917, a tube bender is illustrated wherein the handle connected to the mandrel is provided with an offset and improved scale means are provided on the mandrel for indicating the extent of the formed bend. Three cooperating scale means are provided, including an angular scale on the mandrel, a scale extending from a point on the mandrel aligned with the cross-sectional center of the tube receiving space, and a mark on the mandrel at a predetermined distance from the bend start point.

In Kowal U.S. Pat. No. 3,926,028, the tube bender is provided with a vise mounting portion in lieu of the handle secured to the mandrel. In one form, the hook is formed integrally with the male clamp portion, and in a second form, the hook is pivotally mounted thereon. A scale is provided on the mandrel and a plurality of cooperating indicia are provided on the shoe.

In U.S. Pat. No. 3,750,447 of the inventor herein and William R. Saddler, a further improved tube bender is illustrated having fixed hook means with a cutout space being provided in confrontation to the hook to permit facilitated installation of the tube to be bent into the tool, notwithstanding the fixed relationship of the hook to the mandrel. Cooperating scale means on the mandrel and indicator means on the shoe are provided for indicating the angular extent of the bend.

SUMMARY OF THE INVENTION

The present invention comprehends an improved tube bender construction having adjustable indicia means for providing accurate correlation in indicating the angular extent of the formed bend in the tube.

More specifically, the invention comprehends, in one embodiment, the provision of an adjustable scale on the mandrel. The scale may be provided on a scale member which is adjustably secured to the mandrel as by suitable threaded securing means.

In another form, the adjustable indicia means comprises an adjustable indicator movable with the forming member In the illustrated embodiment, the indicator comprises a pointer movable with the forming member pivot for indicating the angular position of the forming member in the bending operation.

The indicia means may be locked in the adjusted disposition by suitable locking means.

In one form, each of the scale means and indicator means is adjustable for further improved accurate correlation therebetween.

In the illustrated embodiment, the forming member indicator may comprise a pointer carried by the forming member pivot means extending radially outwardly from the bend axis to adjacent an arcuate scale carried on the mandrel. The pointer may be adjustably mounted to the pivot element for providing the desired adjustment in the positioning thereof relative to the mandrel scale. A threaded securing element is provided for adjustably locking the pointer to the pivot element.

The mandrel scale may be provided on an arcuate element adjustably secured to the mandrel by a screw passed through an arcuate slot therein.

The adjustable indicia means of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
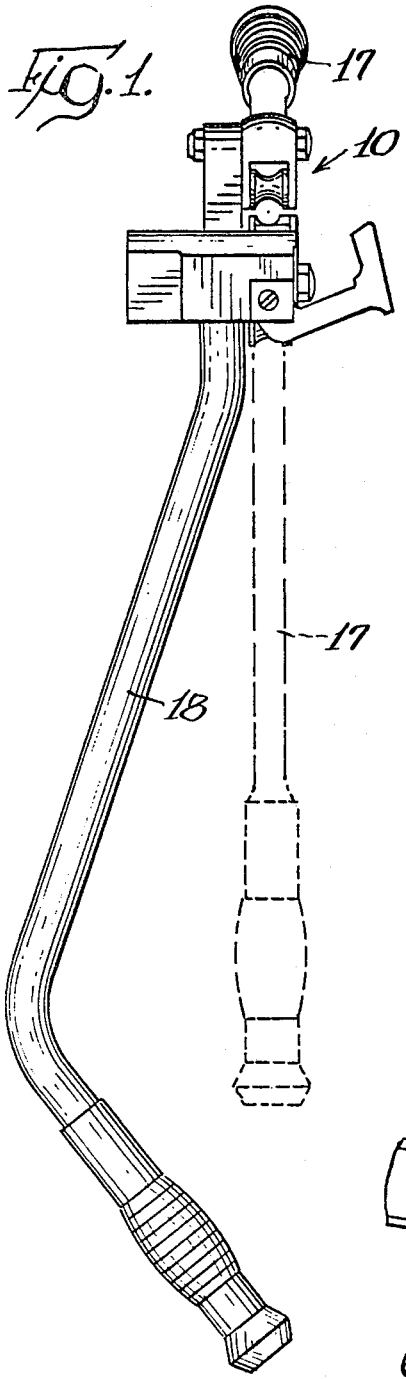
FIG. 1 is an elevation of a tube bender embodying the invention.

In the exemplary embodiment of the invention as disclosed in the drawing, a manually operable tube bender generally designated 10 is shown to include a mandrel 11 defining an annular peripheral bending groove 12. A tube to be bent T is bent into the forming groove by a forming member 13 which is swung about a bending axis 14 of the groove 12 by its connection to the mandrel through a link 15. The tube to be bent is held against longitudinal movement during the bending operation by a holding means generally designated 16.

Movement of the forming member 13 about axis 14 is effected by suitable manipulation of a pair of handles 17 and 18 connected respectively to the forming member 13 and mandrel 11.

Figure 2:
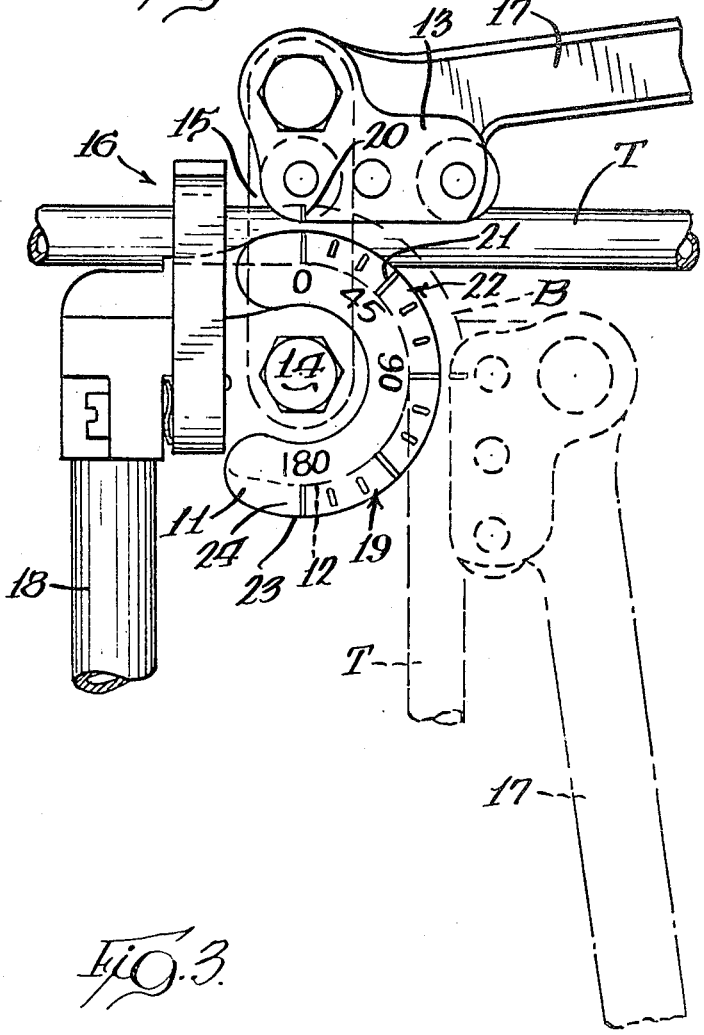
FIG. 2 is a fragmentary side elevation thereof with the forming member shown in a 90° bend position in broken lines.

As shown in FIG. 2, the mandrel 11 is provided with a suitable scale 19 and forming member 13 is provided with a cooperating indicia indicator mark 20 for indicating the angular extent of the bend B formed in the tube T, such as illustrated in broken lines in FIG. 2, wherein a 90° bend is provided in the tube. As shown in FIG. 2, the scale 19 includes angle indicia 21 and is further provided with calibration indicia 22, each comprising a pair of indicia lines 23 and 24 spaced from the angle indicia 21 at the 45°, 90°, 135° and 180° positions 3° and 5°, respectively. Indicia line 23 indicates the necessary position for the forming member indicator 20 at the completion of the desired angle bend where the tube is formed of carbon steel so as to accommodate the 3°-springback of such material in forming such bends. Indicia line 24 provides a similar 5° overbend positioning of the forming member 13 where the tube is formed of hard temper stainless steel wherein a 5°-springback normally occurs in the bending operation.

Figure 3:
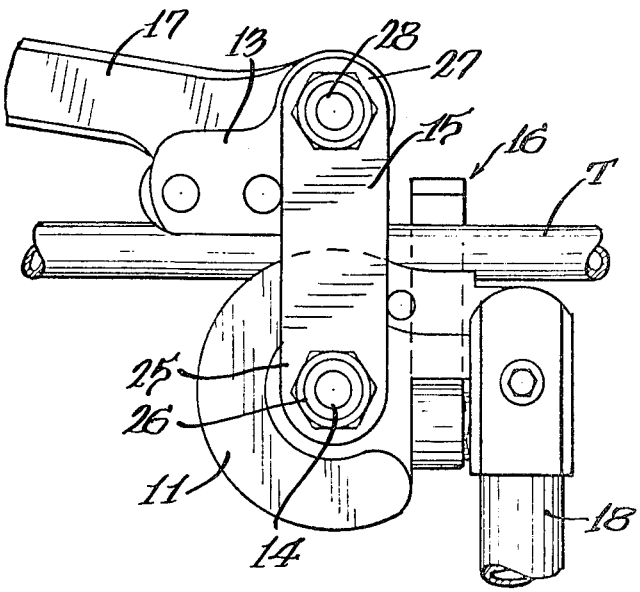
FIG. 3 is a fragmentary rear elevation thereof.
Figure 4:
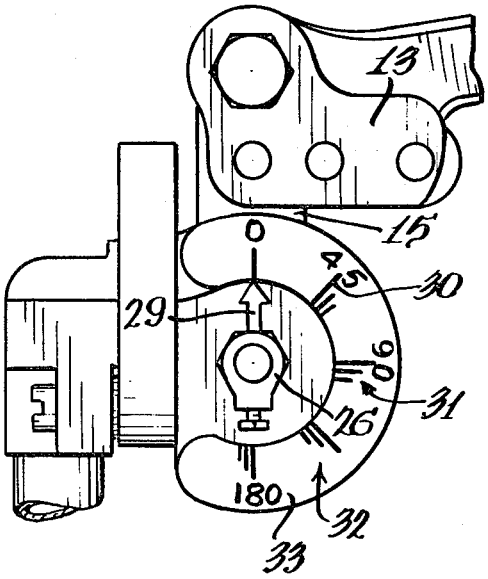
FIG. 4 is a fragmentary side elevation illustrating the provision of an adjustable indicator associated with the forming member in a modified form of tube bender embodying the invention.

Referring now to the embodiment of FIG. 4, a modified form of forming member indicator is provided for use with the calibrated scale 19. More specifically, as shown in FIG. 3, forming member 13 is pivotable about the bend axis 14 by its connection to link 15 having one end 25 mounted to a pivot connector 26 pivotally mounted to the mandrel 11. Forming member 13 is pivotally connected to the opposite end 27 of link 15 by a second pivot member 28, as shown in FIG. 3. Thus, forming member 13 is swung angularly about the mandrel. Pivot 26 pivots therewith on the mandrel.

As shown in FIG. 4, an indicator pointer 29 is secured to the pivot 26 to provide the angle indicator mark associated with the forming member 13 in lieu of the indicator mark 20 of the embodiment of FIG. 2. As further shown in FIG. 4, the angle indicia 30 and calibration indicia 31 of the scale 32 extend to the radially inner edge of the scale element 33 for facilitated cooperation with the indicator 29. Thus, indicator 29 cooperates with scale 32 in the same manner as indicator 20 cooperates with scale 19 of the embodiment of FIG. 2.

Figure 5:
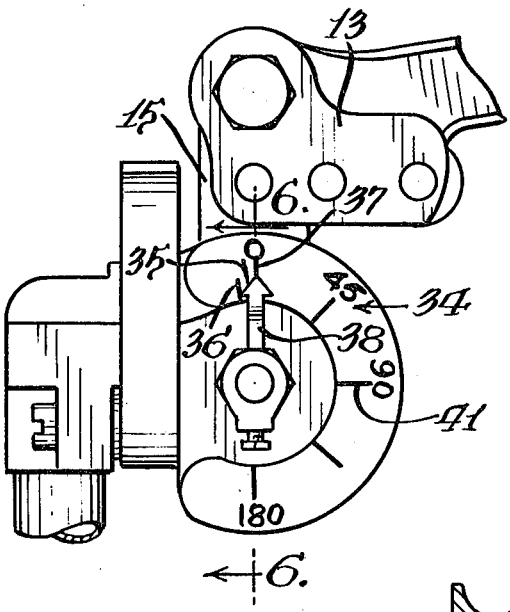
FIG. 5 is a fragmentary side elevation of a tube bender similar to that of FIG. 4, but having a modified mandrel scale.

As shown in FIG. 5, a modified scale 34 may be provided wherein the calibration indicia 35 and 36 for the carbon steel and hard temper stainless steel tubing are provided adjacent the bend start point marking 37 indicated as the 0° marking.

Figure 6:
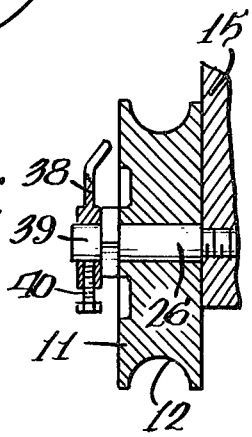
FIG. 6 is a transverse section taken substantially along the line 6—6 of FIG. 5.

As further illustrated in FIG. 6, indicator pointer 38 is adjustably secured to an extension 39 of the pivot 26 by a suitable set screw 40.

Thus, the indicator 38 may be adjusted to align with calibration line 35 when the tube T comprises a carbon steel tube with the forming member disposed in the bend start position similar to the bend start position of FIG. 2. However, as the indicator 38 must move an extra 3 degrees from line 35 to the desired angle indicium 41, such as the 90° angle indicium, the desirable 3°-overbend is automatically produced.

Similarly, where the tube to be bent comprises hard temper stainless steel, the indicator 38 is aligned firstly with the calibration line 36 so as to provide a 5°-overbend when the indicator is brought to the desired angle indicium.

Set screw 40 locks the indicator 38 in the adjusted disposition on pivot 26 so that the bending with the desired over-travel is repeatable with a plurality of successive tubes. Where a succeeding tube comprises a tube formed of a different material, the indicator 38 may be readily adjusted to the proper disposition, such as back to 0-angle bend start point 37, where the tube comprises conventional relatively soft copper tubing.

Figure 7:
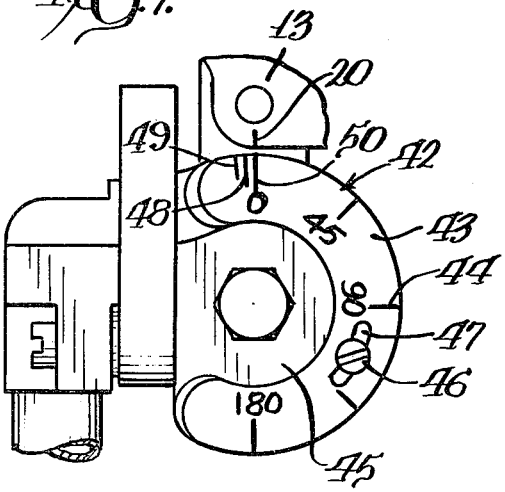
FIG. 7 is a fragmentary side elevation illustrating another form of tube bender embodying the invention having an adjustable scale on the mandrel.

The invention further comprehends the provision alternatively of an adjustable scale means generally designated 42, as illustrated in FIG. 7, utilizing in conjunction therewith the indicator mark 20 of the forming member 13, or alternatively, the fixed indicator 29 of the embodiment of FIG. 4. As shown in FIG. 7, the adjustable scale 42 comprises an arcuate scale plate 43 provided with angular indicia 44. The scale plate is adjustably secured to the mandrel 45 by means of a screw 46 extending through an arcuate slot 47 in the scale plate, the screw being threaded to the mandrel for adjustably locking the scale thereto.

As shown in FIG. 7, calibration indicia lines 48 and 49 may be provided adjacent the 0° scale mark 50, as in the embodiment of FIG. 5.

Thus, in the use of the tube bender construction of FIG. 7, scale plate 43 is suitably adjusted depending on the type of tube to be bent. Thus, illustratively, if the tube comprises hard temper stainless steel tubing, the scale is adjusted to bring calibration line 49 in alignment with the forming member indicator mark 20 with the forming member in the bend start position of FIG. 7. Thus, the angle scale markings are offset 5° so as to cause an automatic 5°-overbend in the hard temper stainless steel tubing when the forming member mark 20 is brought to the desired angular indicium.

As will be obvious to those skilled in the art, the indicator pointer of the embodiment of FIG. 5 may be utilized in lieu of the indicator mark 20 in the adjustable scale tube bender of FIG. 7 within the scope of the invention. As indicated above, where an indicator pointer, such as pointer 38, is utilized mounted to the forming member pivot, the mandrel scale markings may extend to radially inwardly of the scale, such as illustrated in the embodiment of FIG. 4.

Figure 8:
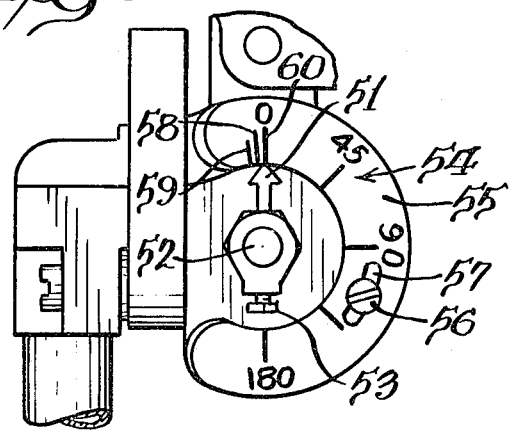
FIG. 8 is a fragmentary side elevation of still another form of tube bender embodying the invention wherein each of the forming member, indicator, and mandrel scale is adjustable.

The provision of an indicator pointer in conjunction with an adjustable scale is illustrated in FIG. 8. Thus, as shown therein, indicator pointer 51 is adjustably mounted to the pivot 52 and secured in the adjusted disposition by suitable set screw 53 to cooperate with an angle scale 54 carried on the adjustable scale plate 55. Adjustment of scale plate 55 is similar to the adjustment of scale plate 43 and thus is effected by means of a suitable locking screw 56 extending through an arcuate slot 57 in the scale plate.

As further shown in FIG. 8, calibration lines 58 and 59 may be provided adjacent the bend start 0° angle mark 60 of the scale 54 whereby the indicator 51 provides an automatic overbend of the harder tubing when desired. In the embodiment of FIG. 8, the overbend may be effected alternatively by adjustment of the scale plate 55 or adjustment of the indicator pointer 51, as desired.

Thus, indicator 51 may be maintained as a fixed indicator if so desired similar to the indicator 29 of the embodiment of FIG. 4.

The improved adjustable indicia means of the above discussed tube benders permits precise calibration of the tube bender with respect to different forms of tubing, as well as with respect to variations in the diameter of the tubing, tool wear, and rough handling of the tool.

Thus, the invention comprehends provision of adjustable indicia means wherein either of the mandrel scale or forming member indicium, or both, may be adjusted to provide an improved accurate correlation between the indicia means in providing a desired angular tube bend.

In use, the operator installs the tube T in the tube bender, as illustrated in FIG. 2, with the tube extending tangentially to the bending groove 12 at the bend start point 24. The hook 36 is swung into engagement with the tube to clamp the tube against extension portion 33 to lock the tube against longitudinal movement during the bending operation. During the installation of the tube, handle 17 is swung in a counterclockwise direction from the position of FIG. 2 to space the forming means 13 from the mandrel, permitting facilitated installation of the tube T. The handle 17 is then swung in a clockwise direction to the full line position of FIG. 2. Suitable manipulation of handles 17 and 18 is then effected to move the forming means 13 circumferentially about the mandrel to effect a bending of the tube into the groove 12 to the desired angular extent.

As indicated above, prior to the movement of the forming member 13, suitable adjustment of the scale or indicator may be effected to calibrate the indicia means for the particular type of tubing being bent. Further, by use of the adjustable indicia means, compensation for wear and the like may be provided to assure the provision of the desired accurate angular extent of the tube bend.

The foregoing disclosure of specific embodiments is illustrative of the broad inventive concepts comprehended by the invention.

I claim:

1. In a tube bender having a mandrel defining a bending groove extending arcuately about a bend axis in a first direction from a bend start position which may vary with the type of tube to be bent, the diameter thereof, wear of the tube bender parts, and the like, means for holding the tube at a holding position adjacent the bend start position in a second direction opposite said first direction, and forming means swingable about said bend axis for urging a tube to be bent progressively into the bending groove, the improvement comprising:

cooperating first and second indicia means associated respectively with said mandrel and said forming means for indicating the angular extent of a bend provided in the tube as a result of movement of the forming means from the bend start position; and adjusting means for angularly adjusting at least one of said first and second indicia means to provide accurate correlation therebetween of the tube to be bent with the bend start position in accurately indicating said angular extent at least one of said indicia means including a bend start indicator portion including a plurality of angularly spaced bend start position indications.

2. The tube bender of claim 1 wherein said first indicia means comprises scale means adjustably carried by the mandrel.

3. The tube bender of claim 1 wherein said first indicia means comprises scale means on the mandrel and said second indicia means comprises an indicator adjustably associated with said forming means.

4. The tube bender of claim 1 wherein said adjusting means includes locking means for locking the adjusted indicia means in the adjusted disposition.

5. The tube bender of claim 1 wherein said adjusting means includes threaded locking means for locking the adjusted indicia means in the adjusted disposition.

6. The tube bender of claim 1 wherein said adjusting means comprises means for adjusting each of said indicia means.

7. In a tube bender having a mandrel defining a bending groove extending arcuately about a bend axis in a first direction from a bend start position which may vary with the type of tube to be bent, the diameter thereof, wear of the tube bender parts, and the like, an angle scale on said mandrel extending in said first direction from said bend start position, means for holding the tube at a holding position adjacent the bend start position in a second direction opposite said first direction, and forming means swingable about said bend axis for urging a tube to be bent progressively into the bending groove, the improvement comprising:

indicator means movable with said forming means for cooperation with said angle scale for indicating the angular extent of a bend provided in the tube as a result of movement of said forming means from the bend start position about said bend axis; and adjusting means for angularly adjusting said angle scale to provide accurate correlation of the tube to be bent with the bend start position and between said scale and said indicator means in accurately indicating said angular extent including means for locking said angle scale in the adjusted disposition.

8. The tube bender of claim 7 wherein said angle scale comprises an arcuate scale element adjustably secured to said mandrel.

9. The tube bender of claim 7 wherein said angle scale comprises an arcuate scale element adjustably secured to said mandrel coaxially of said bend axis.

10. In a tube bender having a mandrel defining a bending groove extending arcuately about a bend axis in a first direction from a bend start position which may vary with the type of tube to be bent, the diameter thereof, wear of the tube bender parts, and the like, an angle scale on said mandrel extending in said first direction from said bend start position, means for holding the tube at a holding position adjacent the bend start position in a second direction opposite said first direction, and forming means swingable about said bend axis for urging a tube to be bent progressively into the bending groove, the improvement comprising:

indicator means movable with said forming means for cooperation with said angle scale for indicating the angular extent of a bend provided in the tube as a result of movement of said forming means from the bend start position about said bend axis; and adjusting means for angularly adjusting said angle scale to provide accurate correlation of the tube to be bent with the bend start position and between said scale and said indicator means in accurately indicating said angular extent, said angle scale including a bend start indicator portion including a plurality of angularly spaced bend start position indications.

11. The tube bender of claim 10 wherein said forming means includes means defining a pivotal connection to said mandrel, said indicator means being mounted to said pivotal connection means.

12. The tube bender of claim 10 wherein said forming means includes means defining a pivotal connection to said mandrel, said indicator means being mounted to said pivotal connection means and extending radially outwardly to adjacent said scale means.

13. The tube bender of claim 10 wherein said forming means includes means defining a pivotal connection to said mandrel, said indicator means being mounted to said pivotal connection means and defining a pointer extending radially outwardly to adjacent said scale means.

14. The tube bender of claim 10 wherein said indicator means extends from said bend axis to adjacent said scale.

15. In a tube bender having a mandrel defining a bending groove extending arcuately about a bend axis in a first direction from a bend start position which may vary with the type of tube to be bent, the diameter thereof, wear of the tube bender parts, and the like, an angle scale on said mandrel extending in said first direction from said bend start position, means for holding the tube at a holding position adjacent the bend start position in a second direction opposite said first direction, and forming means swingable about said bend axis for urging a tube to be bent progressively into the bending groove, the improvement comprising:

indicator means movable with said forming means for cooperation with said angle scale for indicating the angular extent of a bend provided in the tube as a result of movement of said forming means from the bend start position about said bend axis; and adjusting means for angularly adjusting said angle scale to provide accurate correlation of the tube to be bent with the bend start position and between said scale and said indicator means in accurately indicating said angular extent, said angle scale comprising an arcuate scale element and said adjusting means comprises a slot in said angle scale element and threaded securing means extending therethrough.

16. In a tube bender having a mandrel defining a bending groove extending arcuately about a bend axis in a first direction from a bend start position which may vary with the type of tube to be bent, the diameter thereof, wear of the tube bender parts, and the like, means for holding the tube at a holding position adjacent the bend start position in a second direction opposite said first direction, and forming means swingable about said bend axis for urging a tube to be bent progressively into the bending groove, the improvement comprising:

cooperating first and second indicia means associated respectively with said mandrel and said forming means for indicating the angular extent of a bend provided in the tube as a result of movement of the forming means from the bend start position;

adjusting means for angularly adjusting each of said first and second indicia means to provide accurate correlation of the tube to be bent with the bend start position in accurately indicating said angular extent; and locking means for locking each of said first and second indicia means in adjusted disposition.

17. The tube bender of claim 16 wherein said second indicia means comprises a pointer adjustably mounted to said forming means.

18. The tube bender of claim 16 wherein said forming means includes a pivot element rotatable about said bend axis as an incident of swinging movement of the forming means, said second indicia means comprising an indicator movable with said pivot element.

19. The tube bender of claim 16 wherein said first indicia means comprises a plate mounted to said mandrel and provided with scale means.

* * * * *